US007766261B1

(12) United States Patent
Santamarina et al.

(10) Patent No.: US 7,766,261 B1
(45) Date of Patent: Aug. 3, 2010

(54) COMPACT FLUIDIC SPA NOZZLE

(75) Inventors: Aland Santamarina, Columbia, MD (US); Keith Schloer, Owings Mills, MD (US); Alan Romack, Columbia, MD (US); Rosa Korobkov, Timonium, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 231 days.

(21) Appl. No.: 11/585,998

(22) Filed: Oct. 25, 2006

Related U.S. Application Data

(60) Provisional application No. 60/730,831, filed on Oct. 28, 2005.

(51) Int. Cl.
*B05B 1/08* (2006.01)

(52) U.S. Cl. ..... 239/589.1

(58) Field of Classification Search ..... 239/589.1, 239/590, 590.5, 486, 463, 482, 483; 4/541.6
See application file for complete search history.

(56) References Cited

U.S. PATENT DOCUMENTS

| | | | | |
|---|---|---|---|---|
| 2,733,103 | A * | 1/1956 | Laster, Sr. et al. | 239/486 |
| 3,276,464 | A * | 10/1966 | Metzger | 137/836 |
| 5,205,490 | A * | 4/1993 | Steinhardt et al. | 239/449 |
| D450,804 | S | 11/2001 | Srinath et al. | |
| 6,575,386 | B1 | 6/2003 | Thurber, Jr. et al. | |
| 6,729,564 | B2 | 5/2004 | Srinath et al. | |
| 6,904,626 | B1 | 6/2005 | Hester et al. | |
| 6,948,244 | B1 | 9/2005 | Crockett | |

* cited by examiner

*Primary Examiner*—Davis Hwu
(74) *Attorney, Agent, or Firm*—Bacon & Thomas, PLLC

(57) ABSTRACT

A compact, molded liquid oscillator nozzle having a longitudinal axis and a power nozzle, an interaction region having diverging sidewalls, top and bottom walls, and a pair of control ports at opposing sides of the interaction region, and an inertance loop connecting the control ports, characterized in that the inertance loop is molded in a plane that is transverse to the longitudinal axis.

4 Claims, 6 Drawing Sheets

COMPACT FLUIDIC SPA NOZZLE

REFERENCE TO RELATED APPLICATION

The present application is based on provisional application No. 60/730,831 filed Oct. 28, 2005 entitled COMPACT FLUIDIC SPA NOZZLE and claims the benefit of priority thereof.

BACKGROUND AND BRIEF DESCRIPTION OF THE INVENTION

Hester et al U.S. Pat. No. 6,904,626, assigned to the assignee of the present application, discloses a spa tub nozzle having a fluidic oscillator comprised of a power nozzle in the fluidic oscillator that is coupled to a source of water under pressure. The power nozzle projects a jet of water into an interaction region having top, bottom and diverging sidewalls and an inertance loop connecting the control ports to each other. The inertance loop coupling the control ports to each other is comprised of a pair of flat plates with inertance grooves formed therein and having one end juxtaposed over an aperture in sidewalls of the respective control port and a passthrough passage connecting the opposite ends of the grooves to each other. The passthrough passage has a water ingestion port for purging air from the inertance loop.

The present invention incorporates a housing similar to the housing in the above-identified Hester patent. The operative fluidic oscillator component comprises a molded inlet piece having a power nozzle and a very compact inertance loop wound around the control ports in a spiral-like configuration which is in a plane that is transverse to the centerline or longitudinal axis of the fluidic oscillator. The seal plate for the inertance loop is preferably part of a molded outlet piece having portions of the interaction region constituted by a pair of diverging sidewalls, top and bottom walls, and an outlet flange. A jet face member locks the components in position in the housing. A small O-ring fits in a groove on the outer surface of the inlet piece separating the water inlet from an air chamber. A large O-ring fitted in the inlet piece portion constituted by the spiral-like inertance loop provides the air chamber for the entrainment air inlet. The air inlet is coupled through the space occupied by the inertance loop to an elbow which steers the air to an air entrainment orifice in the outlet piece.

Thus, the invention features a compact fluidic spa nozzle, constituted by an inertance loop traversing a continuous path in a plane that it is transverse to the centerline of the fluidic oscillator. The path for feeding entrainment air is through a path that is transverse to the inertance loop. The mold lines for the upstream or inlet piece and the downstream or outlet piece is through the plane of the inertance loop. Control ports are partly formed by both halves of the molding, namely, the upstream inlet piece and the outlet downstream piece. Thus, the invention features a reduced number of parts in its construction assembly. A flow straightener/conditioner is provided on the inlet piece.

Reference is made to the following U.S. patents owned by the assignee hereof and incorporated herein by reference:

U.S. Pat. No. 6,729,564
U.S. Pat. No. 6,904,626
U.S. Pat. No. 6,948,244
U.S. Pat. No. 6,575,386
Des. 450,804

DESCRIPTION OF THE DRAWINGS

The above and other objects, advantages of the invention will become more apparent when considered with the following specification and accompanying drawings wherein.

DETAILED DESCRIPTION OF THE INVENTION

Figure 1:
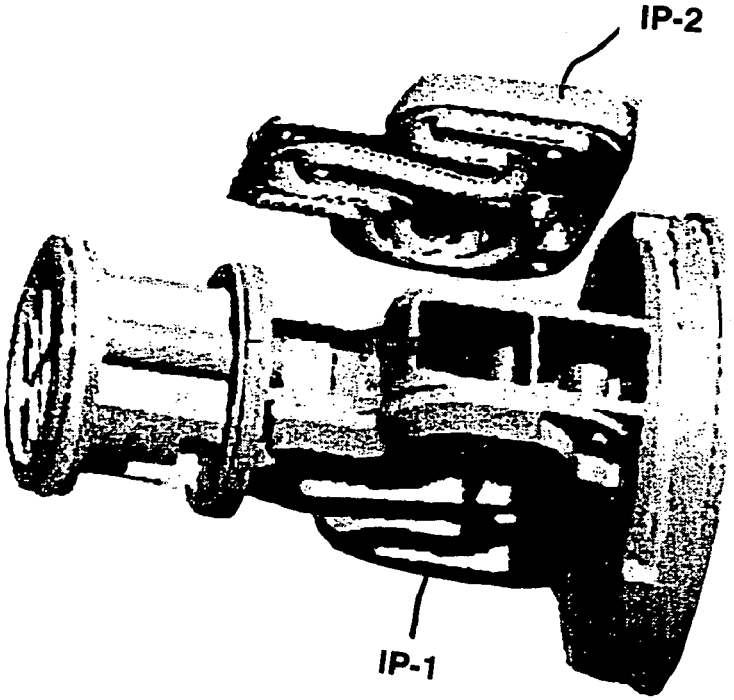
FIG. 1 (PRIOR ART)
FIG. 1 is an exploded view of a fluidic oscillator of the type shown in Hester et al U.S. Pat. No. 6,904,626.

The small compact fluidic oscillating nozzle features a compact continuous inertance loop wound around the control ports in a spiral-like fashion on a plate configuration. Other fluidic spa nozzles utilize grooved, axially oriented inertance plates IP-1, IP-2 as shown in FIG. 1. For a more detailed description of this nozzle shown in FIG. 1, see U.S. Pat. No. 6,904,676.

Another feature of the present invention is that the inertance loop is in a spiral-like configuration and is in a phased three-level weld profile. During the weld process, the inertance plate has three separate welds that occur in a staged process to assure complete weld initiation in all three welds. One weld is a mechanical perimeter weld, used primarily to hold the two halves together. The second weld is a sealing weld that helps to seal and isolate the inertance loop or track CIL. The final weld is used to complete and seal the air passage 33 and 33-O through the inertance track. (The parts may be glued together.)

Figure 2:
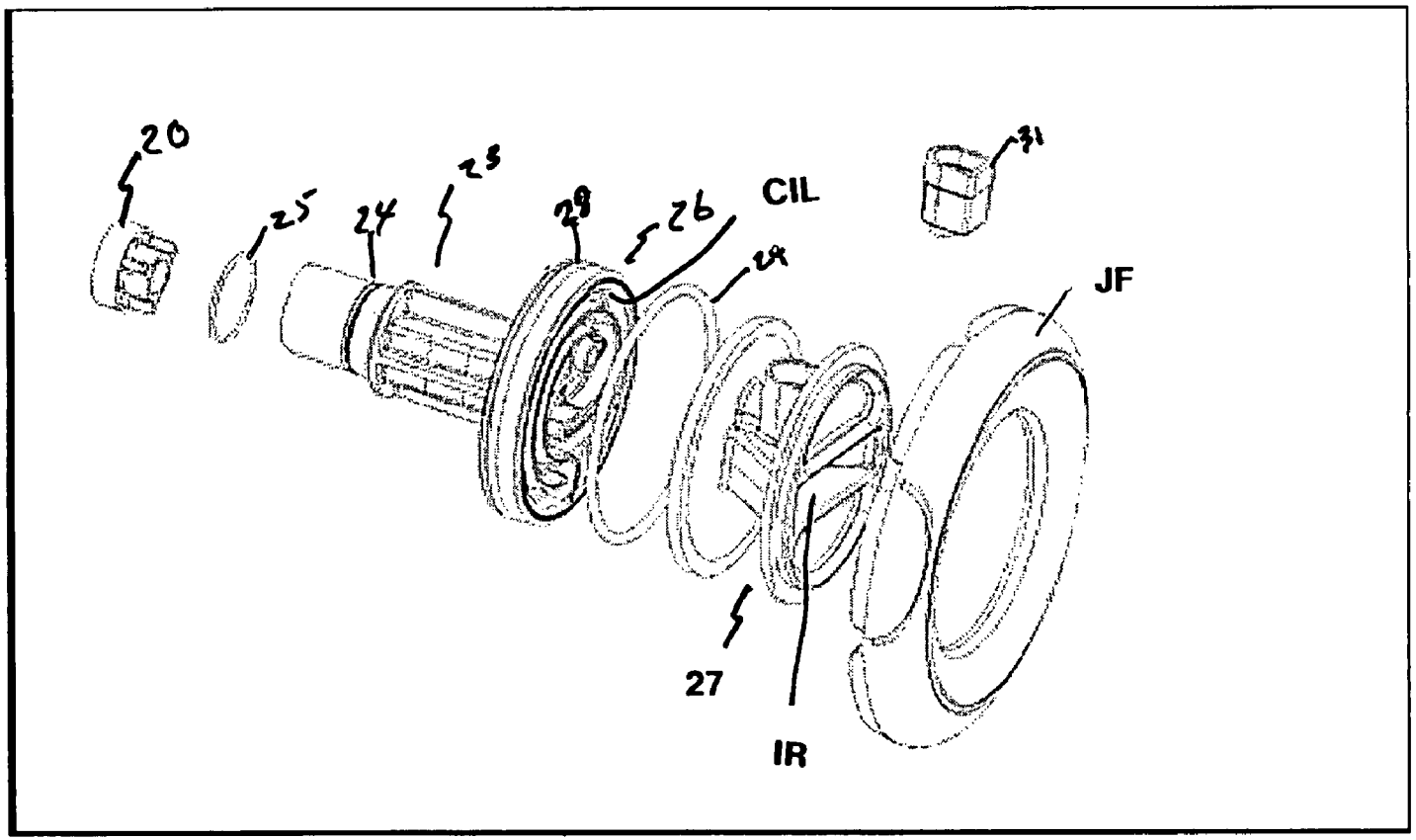
FIG. 2 is an exploded view of a fluidic oscillator incorporating the present invention.
Figures 3A, 3B:
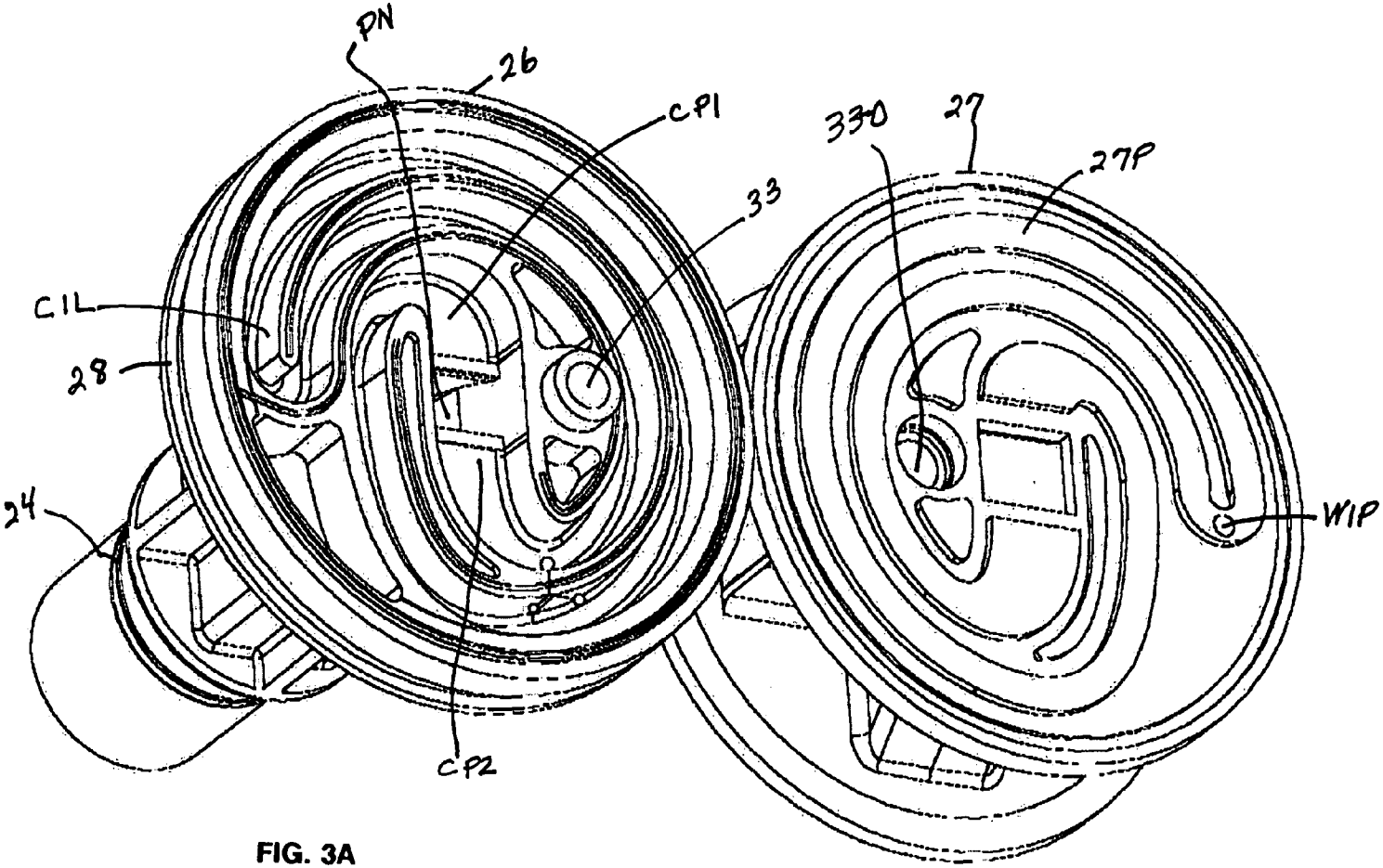
FIGS. 3A and 3B illustrate the continuous inertance loop and its seal faces.

Referring to FIG. 2, the exploded assembly is shown as having a flow control flow straightener or conditioner 20, an inlet piece 23 having an upstream groove 24 for receiving a first seal O-ring 25 to seal the water input chamber WC (FIG. 4A) from the air chamber AC (FIG. 4A), a downstream end 26 having a face that is transverse to the axis of the fluidic oscillator. This transverse face has formed therein the continuous inertance loop "spiral" CIL, the power nozzle PN (FIG. 3A) and the control ports CP1 and CP2 (FIG. 3A) at the respective ends of the continuous inertance loop CIL. A downstream groove 28 receives a second O-ring 29 to form the air chamber AC. A jet face member JF secures the assembled fluidic unit in the housing H.

Figure 4A:
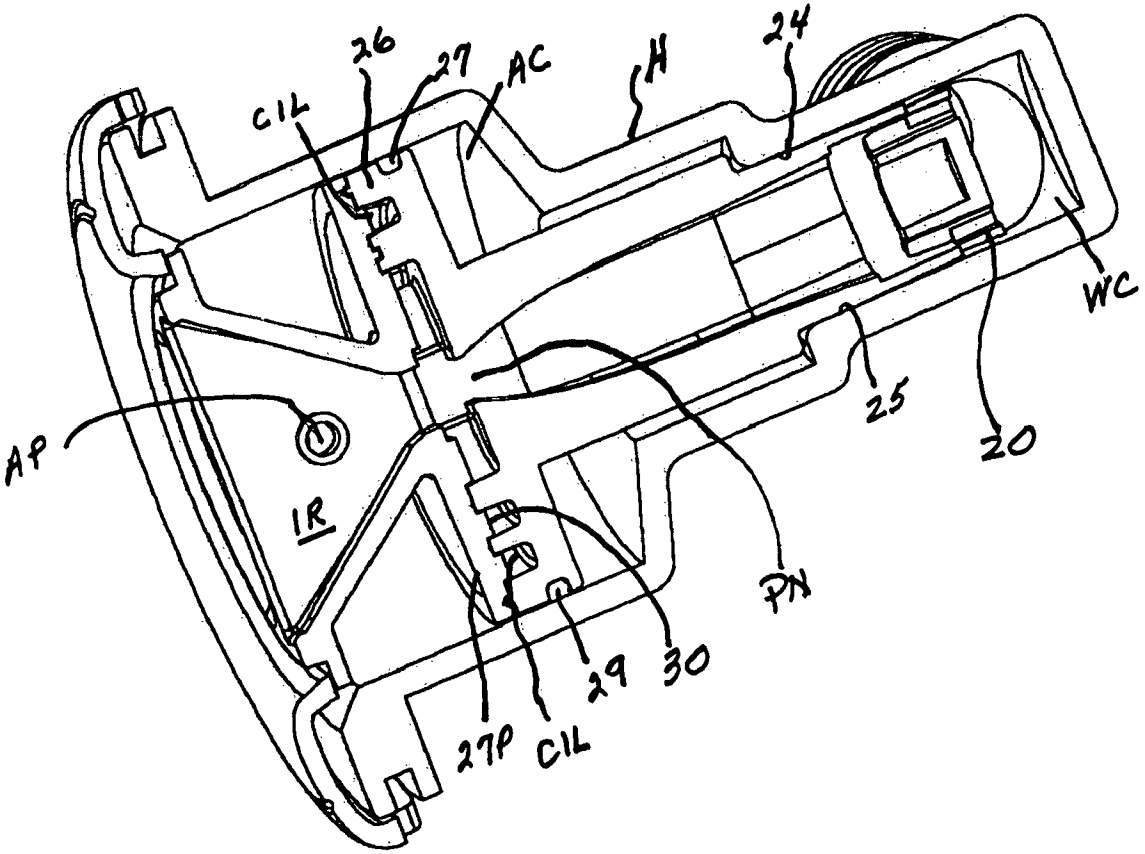
FIGS. 4A, 4B and 4C are sectional views through the fluidic oscillator shown in FIG. 2 in assembled relation in a housing.
Figure 4B:
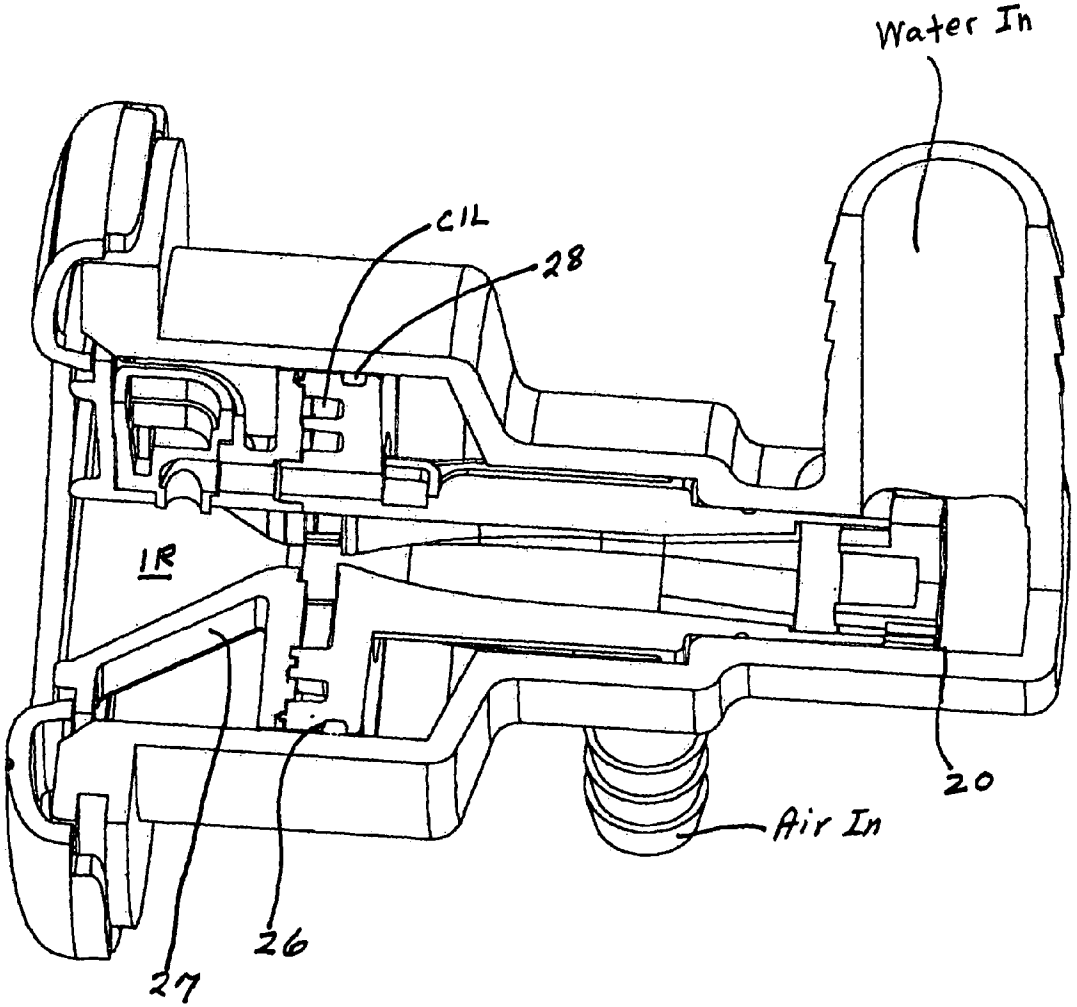
Figure 4C:
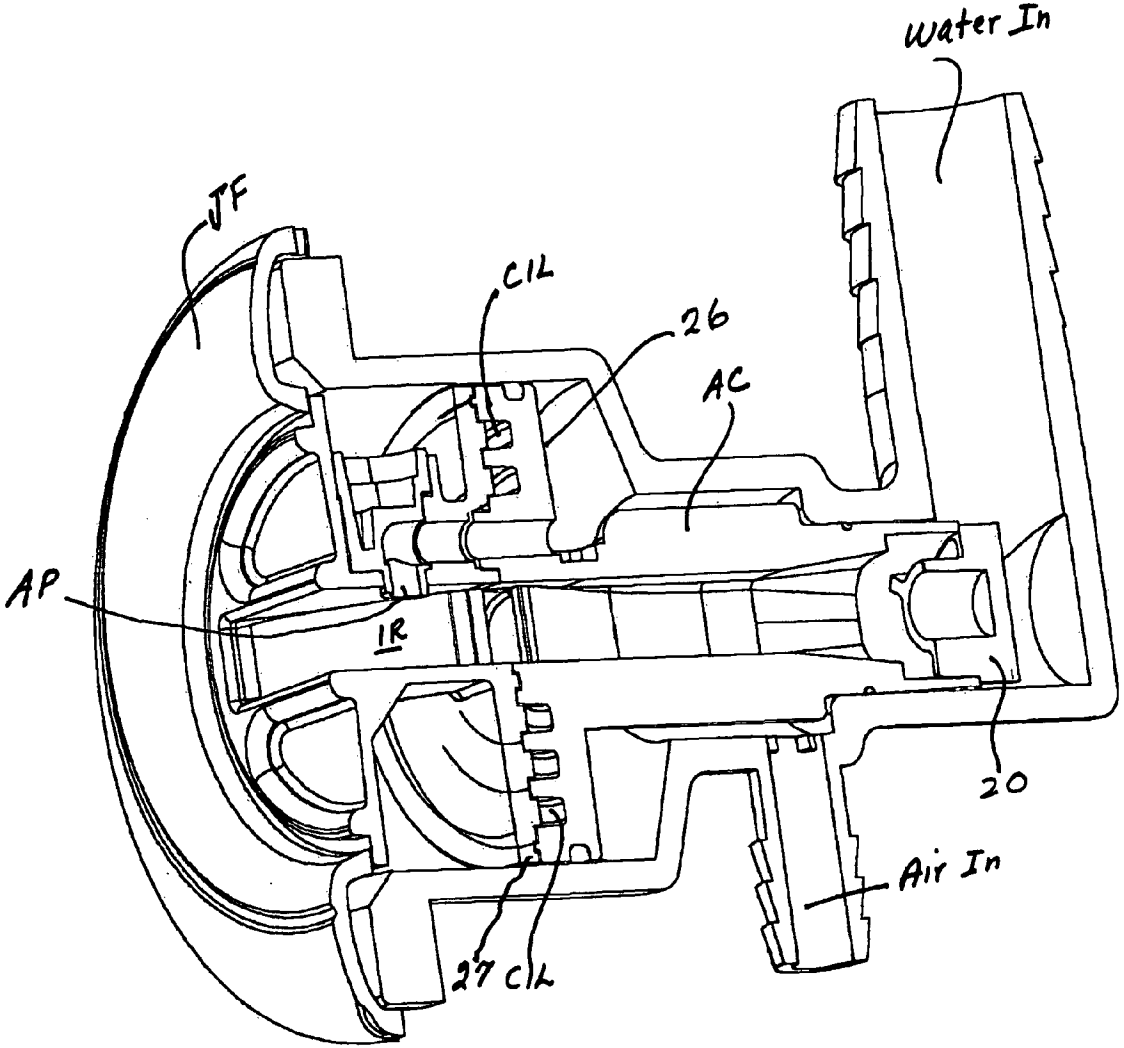

An outlet piece 27 is comprised of a transverse planar plate 27P having complementary seal portions 30 for receiving and sealing the inertance loop 30 in a manner discussed earlier. The outlet piece 27 has a diverging interaction region IR, with an air entrainment port AP (FIG. 4A). Air entrainment port AP is coupled to the air chamber AC by an elbow passage in air plug 31. The air plug 31 couples to an air passage 33 which is formed in the upstream or inlet piece 23 from a controlled air source is supplied to passage 33-O in outlet piece 27. A water ingestion port WIP (FIG. 3B) in outlet piece 27 is provided to purge air from the inertance loop as disclosed in U.S. Pat. No. 6,904,626.

Figure 5:
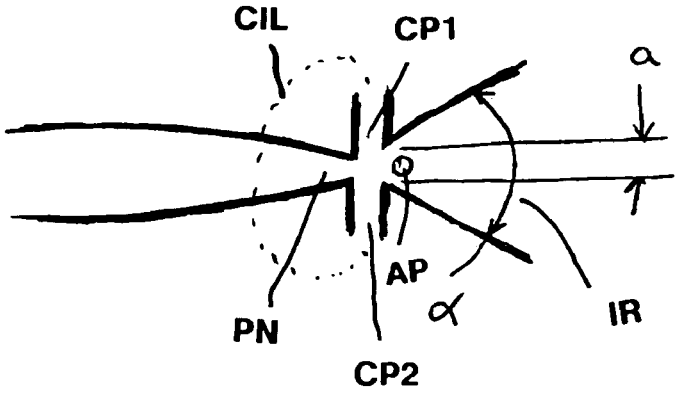
FIG. 5 is a schematic view of the oscillating mechanism of this invention.

As shown in FIG. 5, the fan angle is increased by increasing the width of the power nozzle and the divergence of the sidewalls of the interaction region IR. This wide fan angle was chosen to get maximum feel to the occupant back at close distances.

The invention features:

A compact, molded liquid oscillator nozzle having a longitudinal axis and a power nozzle, an interaction region having diverging sidewalls, top and bottom walls, and a pair of control ports at opposing sides of said interaction region, and an inertance loop connecting said control ports, characterized in that said inertance loop is molded in a plane that is transverse to said longitudinal axis. Preferably, the transverse plane is orthogonal.

The compact liquid oscillator nozzle defined above in which said compact inertance loop is wound around said control ports in a spiral-like configuration.

The liquid oscillator nozzle defined above wherein said fluidic oscillator has a molded inlet piece having said power nozzle and said inertance loop and control port molded therein and a molded outlet piece having the diverging sidewalls and top and bottom walls of said oscillator and a seal plate for said inertance loop formed as a part of said molded outlet piece.

While the invention has been described in relation to preferred embodiments of the invention, it will be appreciated that other embodiments, adaptations and modifications of the invention will be apparent to those skilled in the art.

What is claimed is:

1. In a compact, molded liquid oscillator nozzle having a longitudinal axis and a power nozzle, an interaction region having diverging sidewalls, top and bottom walls, and a pair of control ports at opposing sides of said interaction region, and an inertance loop connecting said control ports and arranged to cause a main fluid flow along said axis to oscillate between said diverging sidewalls, the improvement wherein said inertance loop extends around a main fluid flow path through said nozzle and is molded into said nozzle in a plane that is transverse to said longitudinal axis, said compact inertance loop being wound around said control ports in a spiral-like configuration.

2. The compact liquid oscillator nozzle defined in claim 1 wherein said fluidic oscillator has a molded inlet piece having said power nozzle and said inertance loop and control ports molded therein and a molded outlet piece having the diverging sidewalls and top and bottom walls of said oscillator and a seal plate for said inertance loop formed as a part of said molded outlet piece.

3. The compact liquid oscillator defined in claim 1 including a water ingestion port in said inertance loop for purging air from said inertance loop.

4. In a compact, molded fluidic spa nozzle including a fluidic oscillator having a longitudinal axis and a power nozzle, an interaction region having diverging sidewalls, top and bottom walls, and a pair of control ports at opposing sides of said interaction region, and an inertance loop connecting said control ports, the improvement wherein said fluidic oscillator includes a molded inlet piece in which said power nozzle and said inertance loop and control ports are molded, said inertance loop extending around a main fluid flow path through said nozzle, said fluidic oscillator further including a molded outlet piece having said diverging sidewalls and top and bottom walls of said oscillator and a seal member for said inertance loop formed as a part of said molded outlet piece, and said compact inertance loop being wound around said control ports in a spiral-like configuration.

* * * * *